United States Patent [19]

Salam

[11] Patent Number: 4,742,632

[45] Date of Patent: May 10, 1988

[54] ENHANCED MATRIX DISPLAYS

[75] Inventor: Hassan P. A. Salam, London, United Kingdom

[73] Assignee: Unisplay S.A., Firbourg, Switzerland

[21] Appl. No.: 737,080

[22] Filed: May 23, 1985

[30] Foreign Application Priority Data

May 23, 1984 [GB] United Kingdom ..... 8413139

[51] Int. Cl.[4] ..... G09F 9/00

[52] U.S. Cl. ..... 40/449; 40/446; 40/491; 340/815.17; 340/815.24; 362/321

[58] Field of Search ..... 40/446, 447, 449, 437, 40/579, 470, 491, 489; 340/815.06, 815.07, 815.08, 815.09, 815.17; 362/321, 320, 319, 324, 325, 322, 323, 283, 281

[56] References Cited

U.S. PATENT DOCUMENTS

| | | | |
|---|---|---|---|
| 1,114,267 | 10/1914 | Jones | 40/437 |
| 1,178,292 | 4/1916 | Brandquist | 362/321 |
| 1,436,370 | 11/1922 | Thomas | 362/321 |
| 1,674,981 | 6/1928 | Mills et al. | 340/815.17 |
| 1,739,850 | 12/1929 | McKinney | 40/489 |
| 2,124,090 | 7/1938 | Tournay-Hinde | 40/437 |
| 2,509,438 | 5/1950 | Kennelly | 362/321 |
| 2,785,293 | 3/1957 | Smith et al. | 362/319 |
| 3,026,512 | 3/1962 | Baker | 340/815.24 |
| 3,149,430 | 9/1964 | Szabo et al. | 40/447 |
| 3,322,482 | 5/1967 | Harmon | 350/269 |
| 3,335,512 | 8/1967 | Newman | 340/764 |
| 3,381,288 | 4/1968 | Van Vlodrop | 340/815.07 |
| 3,422,426 | 1/1969 | Bailey et al. | 340/815.24 |
| 3,562,938 | 2/1971 | Salam | 40/446 |
| 3,601,914 | 8/1971 | Fuller Jr. | 350/269 |
| 3,680,083 | 7/1972 | Pihl | 340/373 R |
| 3,792,540 | 2/1974 | Watanabe | 40/449 |
| 3,963,326 | 6/1976 | Buchert | 340/815.07 |
| 3,975,099 | 8/1976 | Taylor | 350/266 |
| 4,003,149 | 1/1977 | de Vries | 40/447 |
| 4,045,895 | 9/1977 | Work | 40/447 |
| 4,048,493 | 9/1977 | Lee | 362/321 |
| 4,053,340 | 10/1977 | Woril | 40/447 |
| 4,177,458 | 12/1979 | Wakatake | 40/449 |
| 4,255,737 | 3/1981 | Casteel | 340/815.26 |
| 4,381,112 | 4/1983 | Dupuy | 40/449 |
| 4,429,478 | 2/1984 | Bruce-Sanders | 40/447 |
| 4,462,067 | 7/1984 | Altman | 362/321 |
| 4,466,207 | 8/1984 | Salam | 40/449 |
| 4,468,720 | 8/1984 | Arai | 362/323 |

FOREIGN PATENT DOCUMENTS

| | | | |
|---|---|---|---|
| 2805109 | 8/1979 | Fed. Rep. of Germany | 40/449 |
| 1458189 | 10/1966 | France | 40/449 |
| 139177 | 12/1979 | German Democratic Rep. | 340/764 |
| 14272 | 11/1886 | United Kingdom | 40/447 |
| 369036 | 3/1932 | United Kingdom | 40/449 |
| 941696 | 11/1963 | United Kingdom | 40/449 |
| 1450530 | 9/1976 | United Kingdom | 40/449 |

*Primary Examiner*—Gene Mancene
*Assistant Examiner*—J. Hakomaki
*Attorney, Agent, or Firm*—Watson, Cole, Grindle and Watson

[57] ABSTRACT

A matrix display of the back-illiminated electromechanical type has enhanced picture display features by including display elements whose brightness is individually adjustable.

In one arrangement, each display element has an aperture and an opaque shutter selectively settable to each one of at least three stable positions. In one position, the shutter covers the aperture completely, and in the other positions, it uncovers the aperture to a differing extent so as to pass light of differing intensity depending on the position.

The activating mechanism for the matrix display is a moving head having two magnetic actuators arranged side-by-side for each row of display elements. One magnetic actuator serves to accelerate the shutter of a selected display element, and the other applies a braking force to halt the shutter in the desired position so as to control the brightness of the display element.

By providing a group (e.g. three) of differently-tinted display cells for each matrix element, a color display can be produced.

5 Claims, 4 Drawing Sheets

ENHANCED MATRIX DISPLAYS

FIELD OF THE INVENTION

This invention concerns improvement of matrix displays of the moving head type, in which each display element in the matrix includes a member movable between states which provide contrasting appearances.

DESCRIPTION OF THE PRIOR ART

A display of this type is disclosed in U.S. Pat. No. 3,562,938 wherein each member of a display element is movable between two stable states in one of which the element appears dark and in the other of which it appears bright, for example by back-illumination of the display matrix. The result of this is that each element in the display can only provide two states of contrasting appearance.

U.S. Pat. Nos. 3,026,512; 3,680,083; 3,792,540 describe display elements having more than two visual states. These arrangements require one or more electromagnets for every display element. Because of this, the cost of making a matrix with a large number of such display elements is high. None of these display elements is analog, i.e. capable of very fine adjustment of the brilliance of the display element.

U.S. Pat. No. 4,177,458 describes a matrix display in which each display element includes four different stable display states i.e. colours. The display elements are cubes mounted for rotating about horizontal axes and are traversed by fixed head provided with three electromagnets for each row of display elements whereby a desired display state may be selected. Because of the multiplicity of electromagnets the cost of making the display is high and furthermore none of the display elements is analogue i.e. capable of very fine adjustment of the brilliance of the display element.

SUMMARY OF THE INVENTION

An object of the present invention is to provide a matrix display of the electromechanical type that has enhanced picture display features. One form of enhancement is the provision of an analog display feature wherein the brightness of each display element is individually adjustable. Another form of enhancement is in the provision of finely adjustable colour as well as brightness, so that the picture quality of colour television pictures can be achieved. Yet another enhancement is in increasing the speed of operation of an electromechanical display.

In its broadest aspect, a display device according to the invention includes an array of back-illuminated display element provided in an opaque member, each element including an aperture in the opaque member and an opaque shutter selectively settable to one of at least three stable positions in each of which different intensities of light are provided by the display element, the display device further including means for selectively setting the shutters in desired ones of the stable positions.

A display device according to another aspect of the invention includes an array of display elements back-illuminated by light from a common source each including an opaque member having an aperture therein and an opaque shutter selectively settable to each one of at least three stable positions in one of which it covers and two of which it at least partially uncovers said aperture, and magnet means arranged to scan and selectively alter the state of a plurality of said elements.

A display device according to still another aspect of the invention includes a row of display elements each including a shutter member movable between stable positions, said device further including first and second magnet means arranged to apply to said shutter member accelerating and braking forces respectively.

DESCRIPTION OF THE PREFERRED EMBODIMENTS

Figure 1:
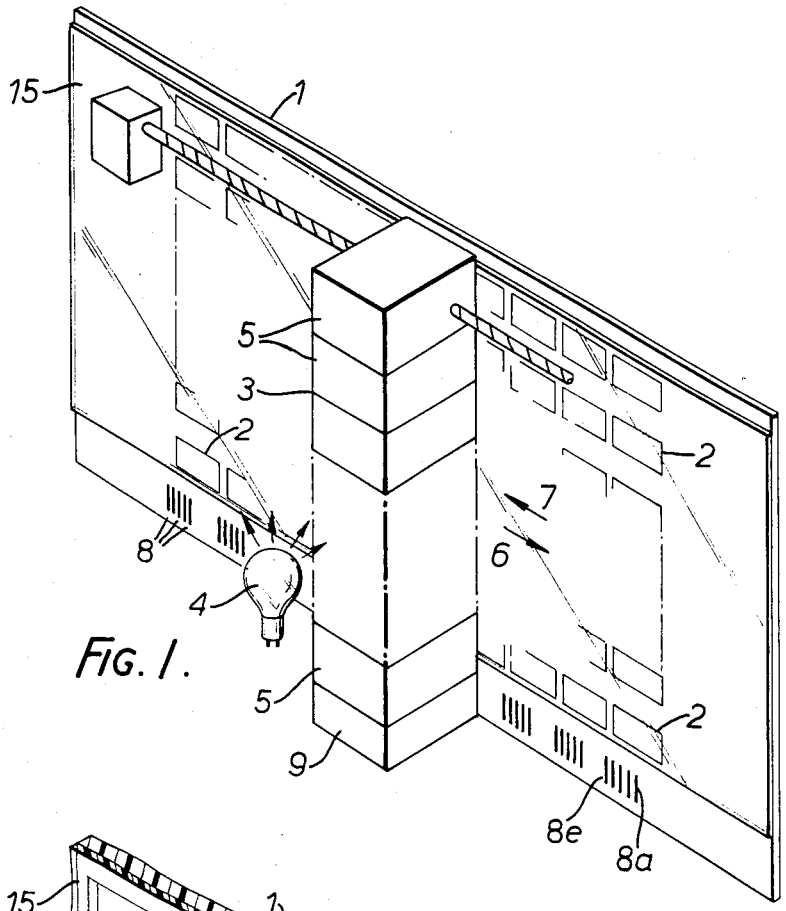
FIG. 1 shows a rear view of a display device using display elements according to the invention.
Figure 2:
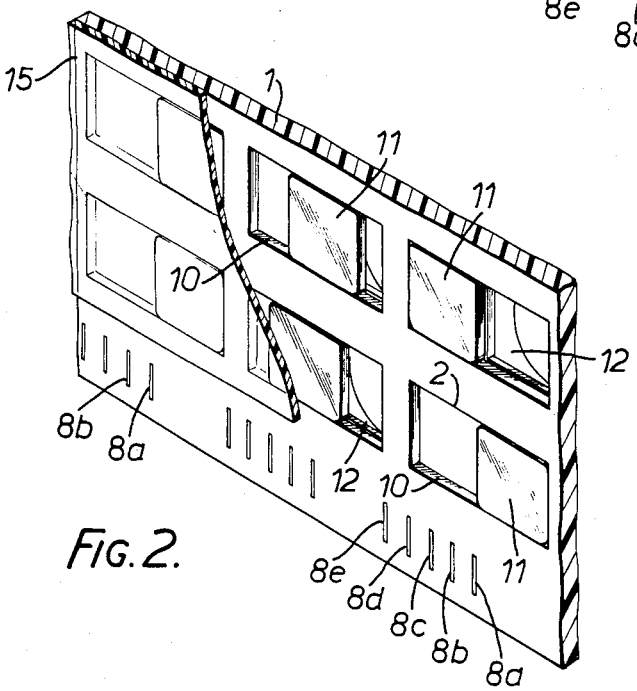
FIG. 2 shows details of a lower part of the device in FIG. 1.
Figure 3:
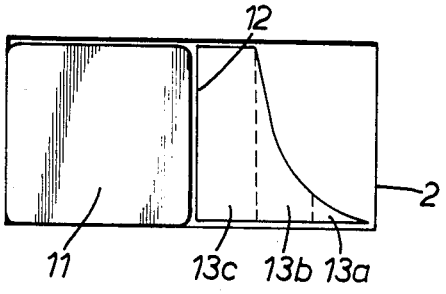
FIG. 3 shows details of a display element according to the invention.

Referring to FIGS. 1, 2 and 3, a matrix display panel 1 includes an array of display elements 2 arranged in horizontal and vertical rows. The display elements 2 are back-lit by a common light source 4. A movable writing head 3 is guided and driven by means of a motor and lead screw for example to travel parallel to the horizontal rows. Writing head 3 includes magnetic actuating means 5 associated with each row of display elements and index mark sensing means 9 arranged to sense a group of index marks 8, marked on panel 1 below each column of cells 2, as each column of cells is traversed by writing head 3. As shown in FIG. 2, each display element 2 consists of a cell 10 in panel 1 containing a rectangular shutter member 11 which is preferably of ferromagnetic material of low remanence, such as soft iron or an equivalent non-tarnishable alloy. Shutter members 11 are retained in their cells by a common transparent or translucent backing sheet 15, shown partially cut away. Cell 10 has a rectangular boundary of a height slightly exceeding that of shutter 11 and of a width about twice that of the shutter. Member 1 is opaque except for an aperture 12 in each cell 10.

FIG. 3 shows one form of aperture 12. It is divided into a number of adjacent zones of equal width but of differing light-passing characteristics. The number of zones can be as high as 15 or more. To simplify the drawings and the description, the number is taken here as three and the zones are indicated as 13*a*, 13*b*, 13*c* respectively. Zone 13*c* can pass more light than zone 13*b* which in turn can pass more light than zone 13*a*. As shown, this is achieved by shaping the actual aperture 12 in a manner whereby the areas of the zones vary in a manner such as to provide the required variation in intensity of illumination between the various positions of the shutter member 11.

Figure 4:
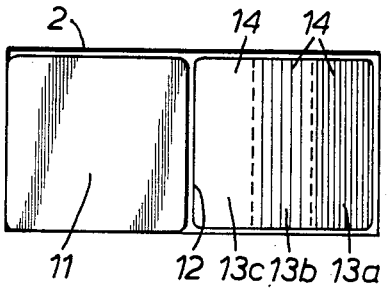
FIG. 4 illustrates an alternative arrangement for the display element.

An alternative form of aperture 12 is shown in FIG. 4. Here aperture 12 is rectangular and includes in its light path a transparent or translucent sheet portion 14 arranged to have three zones 13*a*, 13*b*, *13c* of equal width but of differing light passing characteristics, zone 13*a* being more light attenuating than zone 13*b*, which in turn is more light attenuating than zone 13*c*.

As illustrated in FIG. 2, shutter 11 can take any one of several positions in a cell so as to either block the passage of light through the aperture of the cell entirely, or to pass light through one, two or three of its zones 13. FIG. 2 shows a group of five index marks 8*a*, 8*b*, 8*c*, 8*d*, 8*e* associated with each respective column of cells 2.

Figure 5:
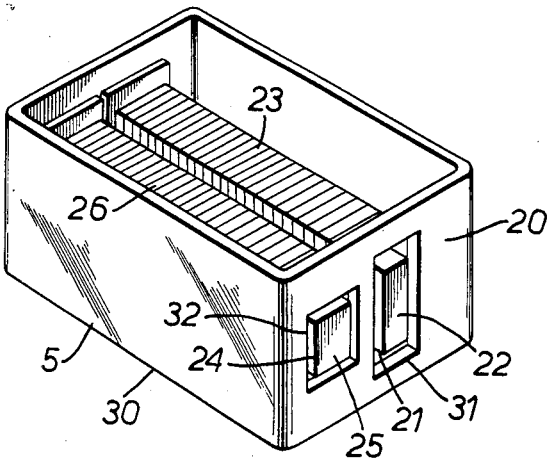
FIG. 5 illustrates magnet means for altering the states of a number of display elements.

FIG. 5 shows details of magnet means 5 used for operating a row of display elements. It includes two electromagnets 21, 24 mounted in a common casing 30 which may be of ferromagnetic material of low remanence or of non-magnetic material such as plastics. Casing 30 has two apertures 31, 32 into which electromagnets 21, 24 respectively are centred, these electromagnets being arranged to have their end faces 22, 25 in the same plane as face 20 of casing 30. Face 20 is disposed towards matrix panel 1 and, as writing head 3 traverses the matrix, pole faces 22, 25 each traverse each display element 2 in a row in turn.

A method of operating the display device is as follows. Starting at the left hand end of panel 1, as viewed in FIG. 1, writing head 3 is traversed across the whole matrix in the direction of arrow 6 with all its electromagnets 21 energised. This causes all shutters 11 to be drawn to the right covering the apertures. The direction of writing head travel is then altered to that of arrow 7 and the shutters in each column in turn are selectively moved to record an image on the matrix. FIGS. 6*a*–6*e* show the position of electromagnets 21 and 24 at the instant within a column scan that index marks 8*a*–8*e* respectively are sensed by sensor 9. To leave aperture 12 completely covered, electromagnets 21, 24 are not energised at all during their sweep across cell 10. To set the shutter 11 to the position shown in one of FIGS. 6*b*, *c*, *d*, electromagnet 21 is turned on from the time mark 8*a* is detected, or somewhat earlier during the cell sweep, until the respective mark 8*b*, *c*, *d* is detected. At this latter instant, electromagnet 21 is turned off and its associated electromagnet 24 is turned on and kept on until the next index mark 8 is detected, or alternatively until the left hand edge of electromagnet 24 has reached the left hand edge of shutter 11. Energisation of electromagnet 24 causes rapid stopping and consequently accurate positioning of shutter 11. Its action on energisation is to clutch shutter 11 against the backing wall sheet 15, shown in FIG. 2, with a force that can be as high as several hundred times the gravitational force on the shutter and also considerably greater than its inertial force due to its movement. The braking occurs as a result of this clutching force and friction between moving shutter 11 and stationary backing sheet 15. Though electromagnet 24 is moving it does not pull the shutter to the left, because it is switched off before passing the left hand edge of shutter 11. During its traverse of the shutter the magnetic reluctance between it and the shutter is substantially constant and there is consequently negligible sideways pull on shutter 11 due to its energisation. The force due to its energisation is substantially normal to its direction of motion. The action of electromagnet 21 is of course different. It is energised while at least part of its face 22 is past the left hand edge of shutter 11. Under this condition the magnetic reluctance between electromagnet 21 and shutter 11 is dependent on their relative sideways position and there is a strong pull to the left on the shutter.

Figure 6A:
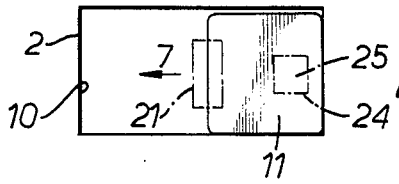
FIGS. 6*a*–6*e* illustrate stages of magnetic actuation of a display element.
Figure 6B:
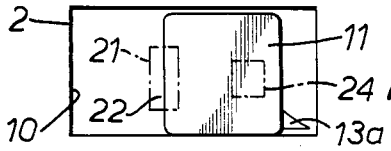
Figure 6C:
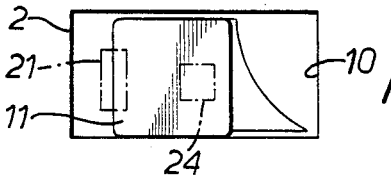
Figure 6D:
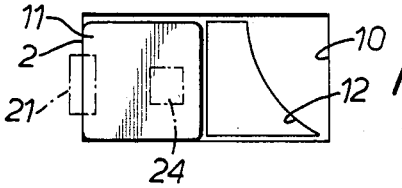
Figure 6E:
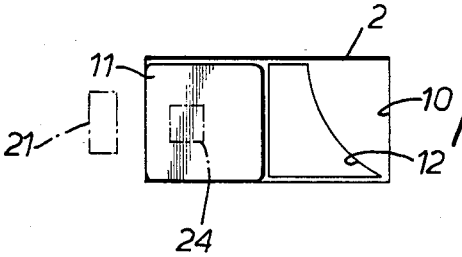

Electromagnet 24 is effective not only in stopping shutter 11 in the intermediate positions shown in FIGS. 6*b* and 6*c* but also in preventing shutter 11 bouncing back to the right after it has reached the position shown in FIG. 6*d*. The use of an electromagnet such as 24 acting as a clutch or brake as useful also in suppressing bounce in displays of the type described in U.S. Pat. No. 3,562,938. In displays of this latter type, there can be a tendency for the shutters to bounce off the sidewalls and settle in the wrong positions in the cells as the speed of writing head travel is increased.

FIG. 5 shows a clutch electromagnet 24 on one side of electromagnet 21. Another clutch electromagnet can be provided on the other side as well, to provide controlled braking of shutters 11 also when writing head 3 is travelling in the direction of arrow 6 in FIG. 1. Alternatively electromagnet 24 can be used for moving the shutter 11 and electromagnet 21 for braking.

For applications that do not require the ability to erase selected parts of the matrix leaving other parts unchanged, electromagnet 21 can be replaced with a permanent magnet. In this case clutch electromagnet 24 is arranged to provide a braking force on shutter 11 that exceeds the sideways pulling force of permanent magnet 21. The operation of the matrix is as follows. The matrix is blanked by traversing writing head 3 across it in the direction of arrow 6. The permanent magnets 21 draw all the shutters 11 to the right, covering the apertures. Writing head 3 is then traversed across the matrix in the direction of arrow 7. As each cell 10 is traversed in this direction by the magnet means 5 of its respective row, shutter 11 is set to the required position (as shown in FIGS. 6*a*, 6*b*, 6*c*, 6*d*) by energising electromagnet 24 starting at the detection of the appropriate index mark (8*a*, 8*b*, 8*c*, 8*d* respectively). Electromagnet 24 is turned off as it reaches the left edge of shutter 11. By this time, magnet 21 is sufficiently remote from shutter 11 to be unable to move it.

Figure 7:
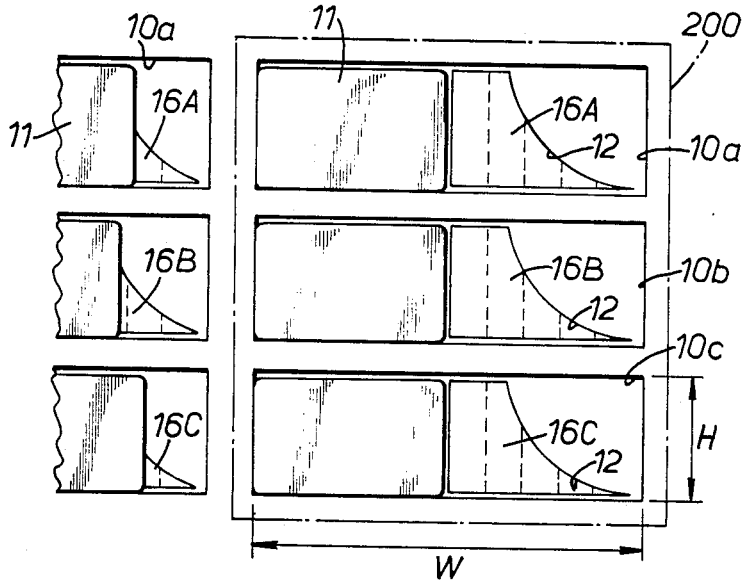
FIG. 7 illustrates a colour display element.

FIG. 7 illustrates an arrangement of cells 10 adapted for colour display. Each cell 10 is arranged to have a ratio of width W to height H exceeding 2 to 1 and preferably of the order of 3.2 to 1. The cells are arranged in groups of three. In each group the cells are stacked vertically and together occupy an area of the matrix that is approximately square. Aperture 12 of each of the three cells 10*a*, 10*b*, 10*c* has a colour filter 16A, 16B, 16C respectively associated with it. Each filter 16 is different from the other two. Filters 16A, 16B, 16C can be blue, green, red respectively. The colour filter means can be mounted behind the apertures 12. The colour of the filter is the same for all cells 10 in a row. The group of three cells constitutes a display element 200 which when viewed from a sufficiently large distance appears as a single dot having a brightness and colour dependent on the settings of the three shutters. A very large range of colours can be displayed by display element 200 by arranging that there are enough settings for shutter 11.

Figure 8:
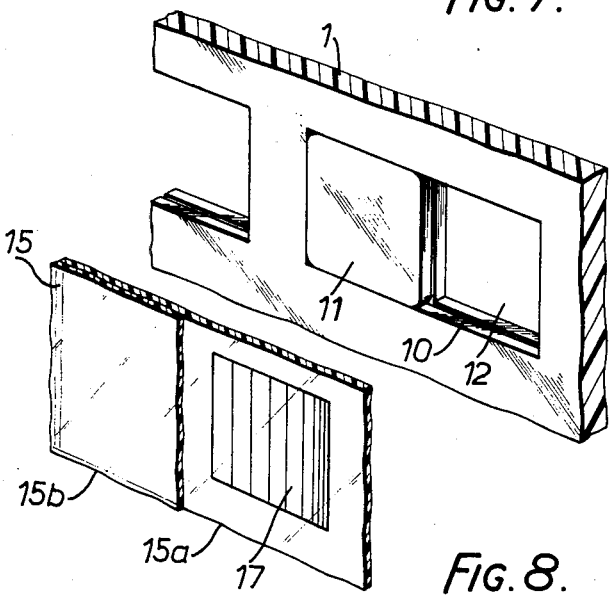
FIG. 8 illustrates in exploded view yet another alternative arrangement for the display element.

A construction of display cell that can be used instead of those described in FIGS. 2, 4, and 7 is illustrated in the exploded view in FIG. 8. Shutter 11 is movable in cell 10 by electromagnet means 5 (not shown) as was described before. Aperture 12 of the cell is in this case rectangular and totally clear. Backing sheet 15 is made of two transparent sheets 15*a*, 15*b* laminated together. Inside the laminate, sheet 15*a* has a translucent rectangle 17 printed onto it aligned opposite each aperture 12. Printed rectangle 17 is arranged to have graduated light-passing characteristics, the right hand portion of it being more opaque to light than the left hand portion, as was described with reference to FIG. 4. Printed rectangle 17 is also preferably arranged to be reflective to light reaching it from outside the display via aperture 12 and through sheet 15*a*. For this purpose, rectangle 17 may be printed with a white or brightly coloured ink with the density of the ink being graduated so that it is slight on the left hand side of rectangle 17 and denser on the right hand side, to achieve the graduated light transmission characteristics. The area outside the rectangles 17 can if desired be made opaque, using black ink.

I claim:

1. A display matrix comprising an array of display elements arranged in rows extending in horizontal and vertical directions, each display element comprising a cell containing a magnetizable display member movable between a plurality of different stable positions within said cell, each row of the rows of display elements which extend in one of said directions being adapted to be actuated by first and second magnet means common to the row, the first and second magnet means being parallely spaced with respect to one another in said one direction and adapted for relative movement across each said display element in the row in turn, said first magnet means being adapted to apply said movable display member a first force acting in the direction from one to another of said stable positions to accelerate said movable member, said second magnet means including a winding for magnetizing it and being adapted to apply to said accelerated movable member a second force orthogonal to said first force and adapted to urge said accelerated member against a portion of said cell to stop movement within the cell of said accelerated movable member, at least one position in said cell at which said display member is brought to rest being dependent on the time of excitation of said winding during said relative movement of said display element and said second magnet means.

2. A display matrix as claimed in claim 1, wherein each said display element comprises an aperture covered by a translucent member illuminated both by ambient light and by back lighting, and each of said movable display members covers said translucent member to a different extent in each of several of said different positions to regulate the amount of light emanating from said display element.

3. A display matrix as claimed in claim 5, wherein said three display elements occupy an approximately square area.

4. A display matrix as claimed in claim 2, wherein each said aperture is approximately triangular.

5. A display matrix as claimed in claim 1, including three vertically stacked display elements each of a different color from the other two.

* * * * *